US005934925A

United States Patent [19]

Tobler et al.

[11] Patent Number: 5,934,925

[45] **Date of Patent: *Aug. 10, 1999**

[54] PATIENT CABLE CONNECTOR

[75] Inventors: David R. Tobler, Westminister; Thomas J. Gerhardt, Littleton; Eugene E. Mason, Boulder; Mike A. Mills, Golden, all of Colo.

[73] Assignee: Masimo Corporation, Irvine, Calif.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/838,392

[22] Filed: Apr. 9, 1997

Related U.S. Application Data

[63] Continuation of application No. 08/543,297, Oct. 16, 1995, Pat. No. 5,645,440.

[51] Int. Cl.[6] ..... H01R 13/62

[52] U.S. Cl. ..... 439/325; 439/377

[58] Field of Search ..... 439/157, 160, 439/325, 328, 345, 357, 358, 372, 607, 909, 931

[56] References Cited

U.S. PATENT DOCUMENTS

| | | | |
|---|---|---|---|
| 3,534,310 | 10/1970 | Pelissier | 336/83 |
| 3,710,303 | 1/1973 | Gallager, Jr. | 439/325 |
| 3,995,209 | 11/1976 | Weston | 322/355 |
| 4,305,401 | 12/1981 | Reissmueller et al. | 128/690 |
| 4,490,003 | 12/1984 | Robinson | 439/325 |
| 4,531,795 | 7/1985 | Sinclair | 439/157 |
| 4,684,245 | 8/1987 | Goldring | 356/41 |
| 4,690,492 | 9/1987 | Beard | 350/96.2 |
| 4,797,125 | 1/1989 | Malana | 439/909 |
| 4,838,808 | 6/1989 | Fujiura | 439/610 |
| 4,961,711 | 10/1990 | Fujiura et al. | 439/610 |
| 5,108,298 | 4/1992 | Simmel | 439/160 |
| 5,209,230 | 5/1993 | Swedlow et al. | 128/633 |
| 5,249,576 | 10/1993 | Goldberger et al. | 128/632 |
| 5,295,852 | 3/1994 | Renn et al. | 439/328 |
| 5,302,133 | 4/1994 | Tondreaut | 439/328 |
| 5,380,213 | 1/1995 | Piorunneck et al. | 439/160 |
| 5,407,368 | 4/1995 | Strand et al. | 439/909 |
| 5,498,235 | 3/1996 | Flower | 439/909 |
| 5,509,823 | 4/1996 | Harting et al. | 439/931 |
| 5,645,440 | 7/1997 | Tobler et al. | 439/160 |

FOREIGN PATENT DOCUMENTS

| | | |
|---|---|---|
| A-85938/91 | 4/1992 | Australia . |
| 2052650 | 10/1991 | Canada . |
| 481 612 A1 | 4/1992 | European Pat. Off. . |
| 538 631 A1 | 4/1993 | European Pat. Off. . |

*Primary Examiner*—Hien Vu

*Attorney, Agent, or Firm*—Knobbe, Martens, Olson & Bear, LLP

[57] ABSTRACT

An electrical connector is disclosed which provides connection of sensors to monitors. The connector is designed to be low-profile, permit ease of attachment and disconnection, and maintain a strong connection to prevent accidental disconnects.

14 Claims, 3 Drawing Sheets

PATIENT CABLE CONNECTOR

This application is a continuation of U.S. patent application Ser. No. 08/543,297, filed Oct. 16, 1995, now U.S. Pat. No. 5,645,440.

BACKGROUND OF THE INVENTION

1. Field of the Invention

The present invention relates to electrical connectors. More specifically, the present invention relates to the connection of medical sensors to instruments responsive to signals from the sensors.

2. Description of the Related Art

Energy is often transmitted through or reflected from a medium to determine characteristics of the medium. For example, in the medical field, instead of extracting material from a patient's body for testing, light, heat or sound may be generated and transmitted. Detection of the transmitted signal allows determination of information about the material through which the signal has passed. For example, during surgery, the body's available supply of oxygen, or the blood oxygen saturation, is monitored. Measurements such as these are often performed by measuring the ratio of incident to transmitted (or reflected) light through a portion of the body, for example a digit such as a finger, or an earlobe, or a forehead. Durable and disposable sensors are often used for such physiological measurements. These sensors have connectors which allow detachment from the instrument or cable from the instrument.

SUMMARY OF THE INVENTION

The present invention involves a connector that is configured to attach both disposable and durable sensors to instruments that are responsive to signals from the sensors or to cables from the instruments. To ensure proper operation, the connector is designed to prevent incorrect attachment of the probe to the connector. Additionally, the connector allows for easy connection and release, yet prevents accidental disconnection. Advantageously, the connector does not add significant noise to the system, and can be coated inside with RF shielding material. Additional, the connector and sensor tab are not sharp and do not contain protrusions that might hurt or scratch the patient.

More specifically, the present invention involves a probe connector for use in both invasive and non-invasive measurements. Examples of sensors are disclosed in FIGS. 29–56 of U.S. patent application Ser. No. 08/543,789, entitled Low Noise Optical Probes, filed on the same day as the present application, which application is incorporated by reference herein.

The connector of the present invention couples the probe to a monitor or processor to analyze the signals from the probe. Once a sensor is inserted into the connector, the sensor is locked in place and the sensor tab (connection portion of the sensor) is shielded from electromagnetic interference. Depressing release buttons provides easy removal of the sensor from the connector. The connector has male and female portions. The female portion forms a receptacle that shields the electrical connection from fluids in the surrounding environment.

One aspect of the present invention involves a connector having a case defining a shroud, the case having a passageway configured to accept a sensor plug. At least one release mechanism has an engagement wedge configured such that when depressed, the engagement wedge unlocks the sensor plug from the case. An electrical connector secured within the case has contacts and is positioned such that the sensor plug, when inserted into the case, engages the contacts of the electrical connector. In one advantageous embodiment, the case further comprises a sensor plug lock, the sensor plug lock being positioned to hold the sensor plug in place when inserted into the case. Advantageously, the case further comprises a stop bar positioned to prevent insertion of the sensor plug beyond a predetermined limit. In one embodiment, the release mechanism contains at least one lift tab designed to urge the sensor plug from the sensor plug lock. In the present embodiment, the lift tab lifts the sensor plug off a locking post when the release mechanism is activated. In one embodiment, the release mechanism has at least one push tab designed to move the sensor plug in a direction out of the case when the push tab is engaged. Preferably, the electrical cable is attached to an electrical signal cable.

Another aspect of the present invention involves a connector having a case defining a shroud. The case has a passageway configured to accept a sensor tab. Advantageously, the case has metallic shielding. At least one release mechanism has an engagement wedge configured such that when depressed, the engagement wedge unlocks the sensor plug from the case. Preferably, the release mechanism also has spring members having metallic shielding. An electrical connector secured within the case has contacts and is positioned such that the sensor plug, when inserted into the case, engages contacts of the electrical connector.

DETAILED DESCRIPTION OF THE PREFERRED EMBODIMENTS

The present invention involves a connector for attaching a sensor or probe to a monitor or processor so that signals from the sensor are transmitted to the processor or monitor. The connector provides easy connection and removal of the sensor to the connector while maintaining a solid connection. The connector has a low-profile design to minimize the amount of physical interference or harm by the connector in the medical environment. For instance, advantageously, the connector does not have sharp edges or protrusions that could scratch or otherwise harm the patient.

Figure 5:
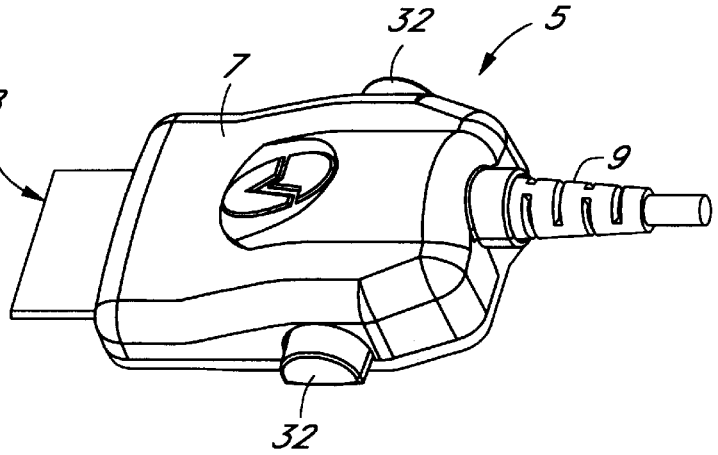
FIG. 5 is a perspective view of one presently preferred embodiment of the connector of the present invention with the male portion connected.

FIG. 5 depicts a perspective view of a connector 5 made in accordance with the present invention. As illustrated in FIG. 5, the connector 5 has a female shroud portion 7, a male insertion portion 8, and a cable portion 9. Electrical connections within the connector 5 are protected from fluids and/or other disturbances by the female shroud portion 7. Although the male insertion portion 8 is shown in FIG. 5 as a blank, in use, this male insertion portion can form a portion of the sensor (e.g., a sensor tab, sensor plug, sensor connector) or be attached to the end of a cable from a sensor. Advantageously, the cable portion 9 connects on one end to contacts within the female shroud portion 7 and on the other end to a monitor or processor.

Figure 1:
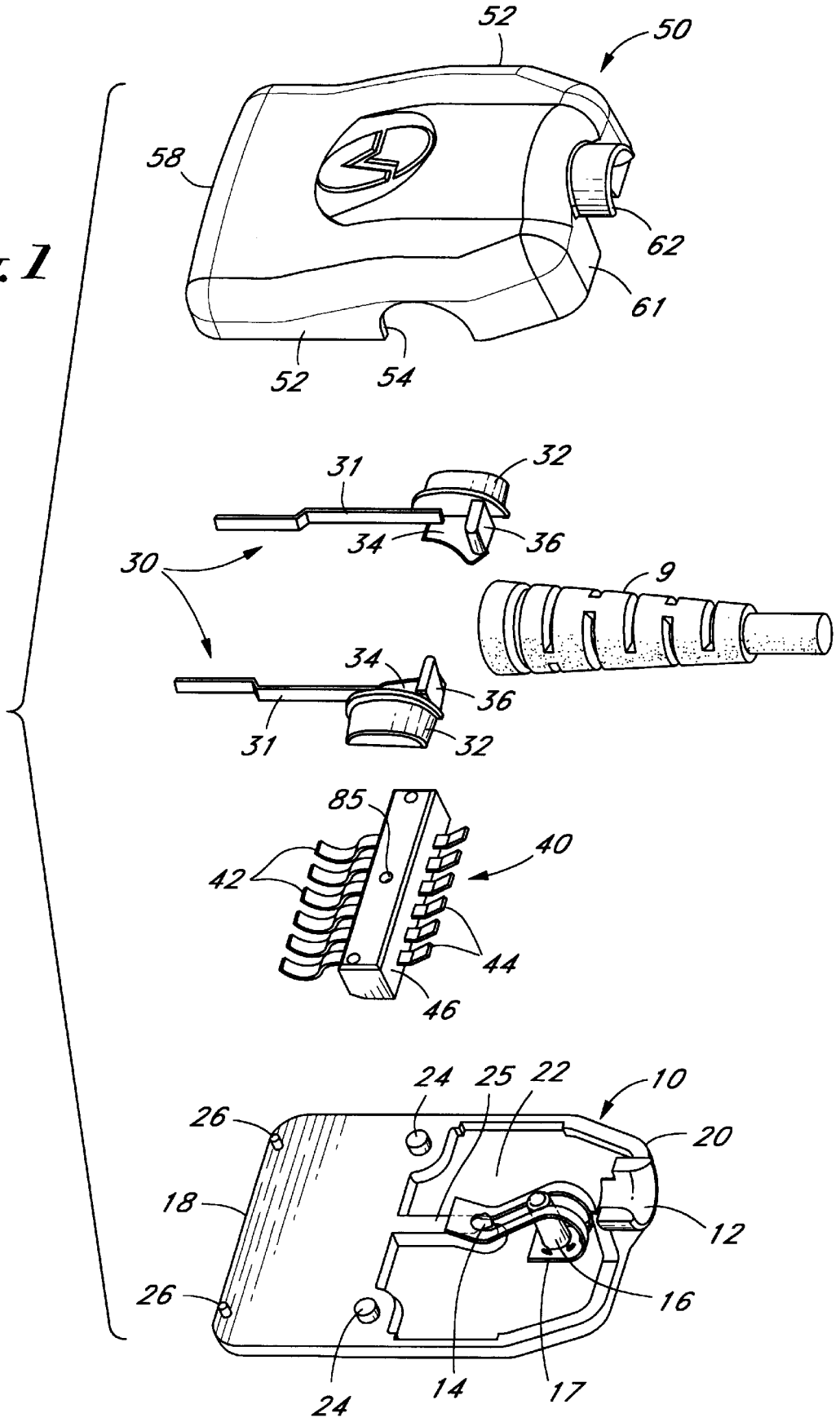
FIG. 1 is an exploded perspective view of one preferred embodiment of the female receptacle of the connector of the present invention.

FIG. 1 depicts an exploded view of the connector 5 of one preferred embodiment. The female shroud portion 7 has a bottom case 10 having a leading edge 18 and a back edge 20. Attached to the bottom case 10 at the center of the back edge 20 is a cable mount 12. The cable mount 12 is used to secure the cable 9 in place, as will be described further below. Although depicted in the middle of the back edge 20, the cable mount 12 can be positioned to one side or the other in alternative embodiments. The female shroud portion 7 also has a top case 50, discussed in further detail below. Advantageously, the female shroud portion 7 is coated inside or outside with a metallic shielding material to provide an electromagnetic shield from interference in the environment. This shields the connection from electromagnetic noise.

An inside face 22 of the bottom case 10 has a sensor lock 14 and a stop bar 16. In one preferred embodiment, the bottom case also has a retaining spring 17 (only depicted in FIG. 1). The retaining spring 17 bears upon the top of the sensor plug 8 when the sensor plug is inserted into the connector. In addition, the retaining spring 17 provides a tactile snap when the sensor plug 8 is inserted and engages the sensor lock 14. The operation of the sensor lock 14 and the stop bar 16 in connection with the sensor plug 8 is discussed further below. The inside face 22 of the bottom case 22 also has elevation posts 24 and positioning posts 26. In the embodiment depicted in FIG. 1, the inside face 22 also has a support table 25 to support the sensor plug 8 when inserted.

Also depicted in FIG. 1 are release mechanisms 30. The release mechanisms 30 consist of release buttons 32, spring members 31, lift tabs 34 and push tabs 36. In one preferred embodiment, the spring members 31 are constructed from an etched copper and contribute to the shielding provided by the female shroud portion. In particular, the holes in the female shroud portion 7 for the release buttons 32 are shielded by the spring members 31 being metallic. Alternatively, the spring members could be made from plastic or the like and coated with a metallic shielding material. The release mechanisms 30 are designed to lift the male insertion portion 8 off the sensor lock 14 and push male insertion portion 8 away from the stop bar 16 to release the male insertion portion 8 from the connector 5. Complete operation of the release mechanisms 30 is described below.

For electrical connection, an contact block 40 is provided in the connector 5. The contact block 40 consists of multiple friction contacts 42 mounted upon a mounting frame 46. Each contact has a connector tab 44 extending from the edge of the contact block 40 opposite from the contact extensions 42. The connector tabs 44 provide for attachment to wires from the cable 9, which wires in turn transmit data to the processor or monitor via the cable 9.

The contact block 40 is fixed in place between the top case 50 of the connector 5 and the bottom case 10. The contact block 40 is supported on the elevation posts 24 which hold the contact block 40 just above the inside face 22 of the bottom case 10.

On each side edge 52 of the top case 50 is an elongated U-shaped release button slot 54. The release button slots 54 are designed to allow the release buttons 32 to protrude from the side edges 52 of the top case 50. Depressing the release buttons 32 into the top case 50 releases the male insertion portion 8 from the female shroud portion 7. When the user releases pressure from the release buttons 32, the force from the connector bars 31 acts as a spring to cause the release buttons 32 to again protrude from the release button slots 54 along the side edges 52 of the top case 50.

Figure 2:
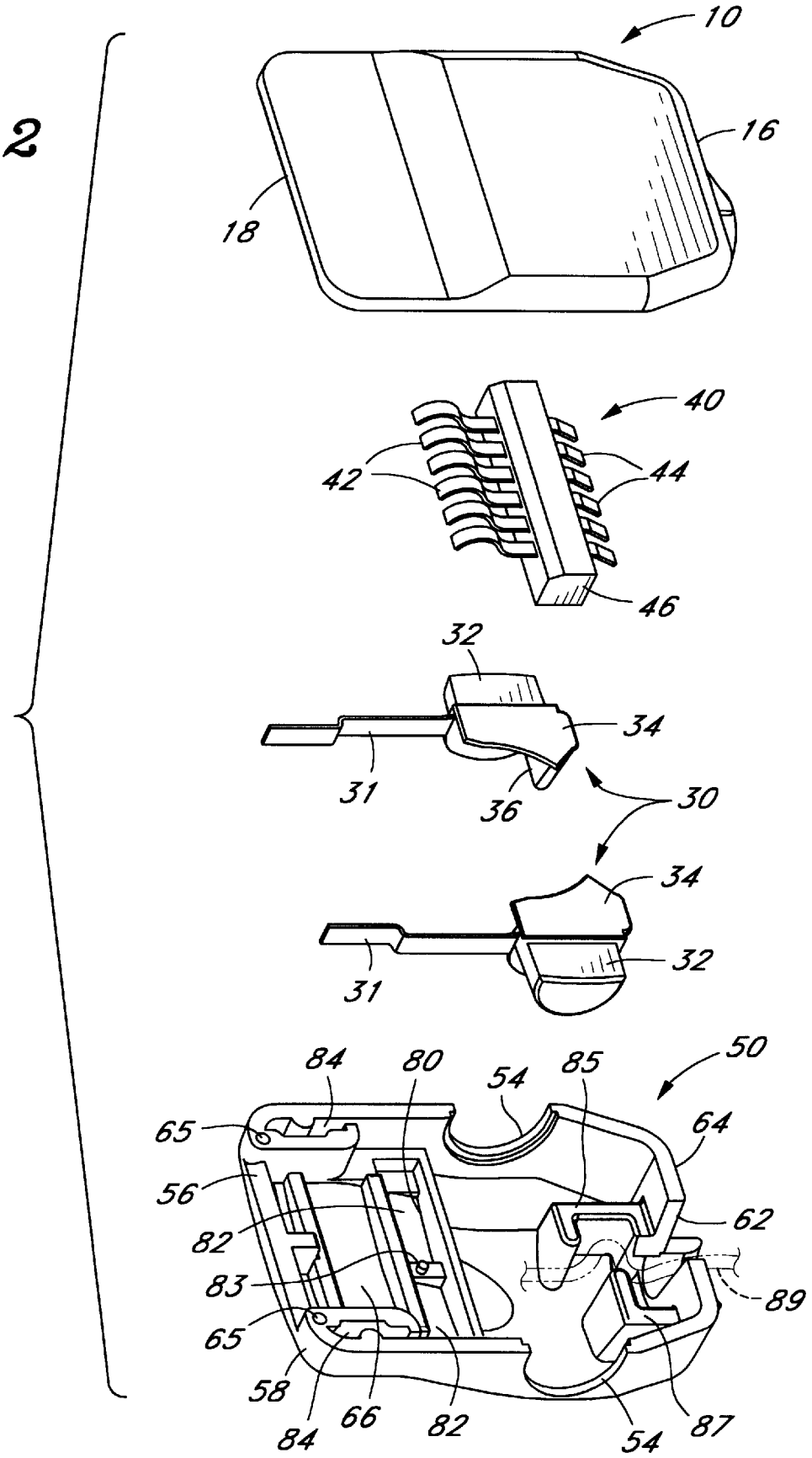
FIG. 2 is an exploded perspective view of the embodiment of FIG. 1 from a different angle.

FIG. 2 depicts a perspective view of the female shroud portion 7 viewed into the top case 50. As illustrated in FIG. 2, along a leading edge 58 of the top case 50 is a male insertion portion slot 56. The male insertion portion 8 is inserted into the male insertion portion slot 56 to position the male insertion portion 8 within the female shroud portion 7. The male insertion portion slot 56 forms an enclosed slot when the top case 50 and the bottom case 10 are attached together.

The top case 50 and bottom case 10 are attached so the leading edge 18 of the bottom case 10 and the leading edge 58 of the top case 50 are aligned, as are a back edge 64 of the top case 50 and the back edge 20 of the bottom case 10. In the preferred embodiment, the top case 50 is glued or sonically welded to the bottom case 10 along all edges. It will be appreciated, however, that any method of attachment may be used without altering the spirit of the invention.

As illustrated in FIG. 2, the inner side of the top case has positioning apertures 65 which function with the positioning posts 26 (FIG. 1) to align the top case 50 and the bottom case 26 when the top case 50 and the bottom case 10 are bonded together. When the top case 50 and bottom case 10 are bonded together, the male insertion portion 8 is insertable between the bottom case 10 and the top case 50 through the sensor slot 56. The provision of the elevation posts 24 (FIG. 1) allows the male insertion portion to pass beyond the contact block along the inside face 22 of the bottom case 10 until the male insertion portion 8 is fully inserted.

A cable guide 62 is also molded into the top case 50 to allow positioning of the cable 9. The cable guide 62 is a slot along and a convex protrusion from the back edge 64 of the top case 50 as illustrated in FIG. 2. The cable guide 62 holds the cable 9 in position to allow the cable 9 to connect with the contact block 40 without the cable 9 interfering with the inner workings of the connector 5.

As illustrated in FIG. 2, the top case also has cable holders 85, 87 which also provide some stress release for the cable. In the present embodiment, the cable holders 85, 87 are L-shaped members offset from each other. Advantageously, the cable wires are weaved between the cable holders 85, 87 as represented by the dotted line 89 in FIG. 2. In a preferred embodiment, the cable is bonded in place with epoxy to firmly fix the cable in place.

The top case tapers from the back edge 64 to the leading edge 58 such that the back edge 64 has a greater height than the leading edge 58 of the top case 50. In addition to allowing cable access, this shape also aids the user in grasping the connector 5 to facilitate release of the male insertion portion from the female shroud portion 7.

As illustrated in FIG. 2, the cable guide 62 is at the back edge 64 of the top case 50. The cable 9 fits into the cable guide 62. The cable 9 is secured between the cable mount 12 on the bottom case 10 and the cable guide 62 of the top case when the top case 50 and the bottom case 10 are bonded together. This prevents the cable 9 from shifting with respect to the female shroud 7.

Also shown in FIG. 2 is a contact holder 80 within the upper case 50. The contact holder 80 contains grooves 82 in which the contact block 40 is inserted. A mounting post 83 is configured to align the contact block 40 properly. The mounting post 83 mates with the positioning hole 85 (FIG. 1) of the contact block 40. The mounting frame 46 of the contact block 40 is placed into the grooves 82 to hold the contact block 40 in place. As can be appreciated, each contact 44 on the contact block 40 may be connected to one or more wires from the cable 9. Advantageously, the opposite end of the cable 9 is coupled to an external processor or monitor where the electrical signals are displayed and processed.

FIG. 2 also illustrates the release button slots 54 in the top case 50. The release mechanisms 30 are inserted into the release button slots 54 so that the release buttons 32 protrude from the sides of the top case 50. The spring members 31 of the release mechanisms 30 position along top case inner side slots 84. After the release mechanisms 30 are inserted, the bottom case 10 is attached to the top case 50, thereby securing the release mechanisms 30, the cable 9, and the contact block 40 in place. The female shroud portion is advantageously made of plastic, resin or the like. The contacts 42 for the contact block 40 are made from conductive material, such as copper or the like.

Figure 3:
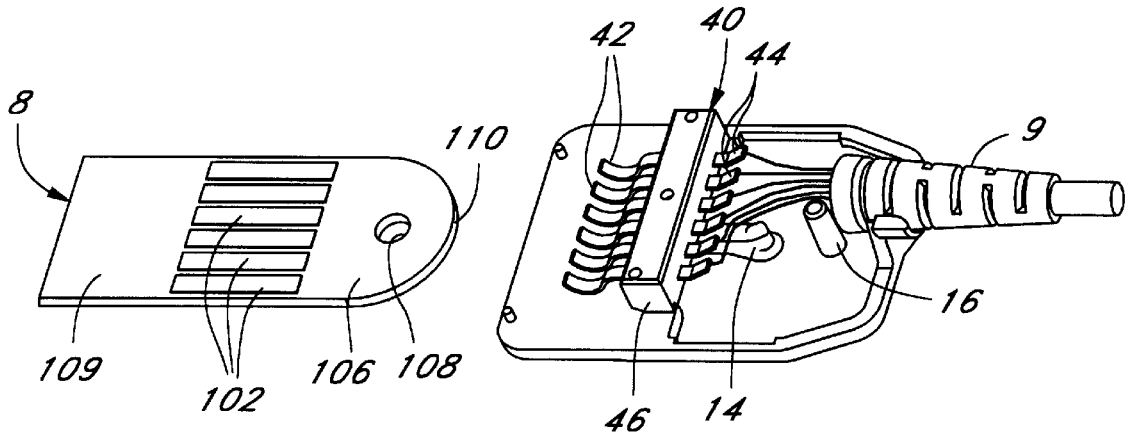
FIG. 3 is a perspective view of one presently preferred embodiment of the connector of the present invention with the male portion disconnected from the connector and the upper portion of the connector not shown.
Figure 4:
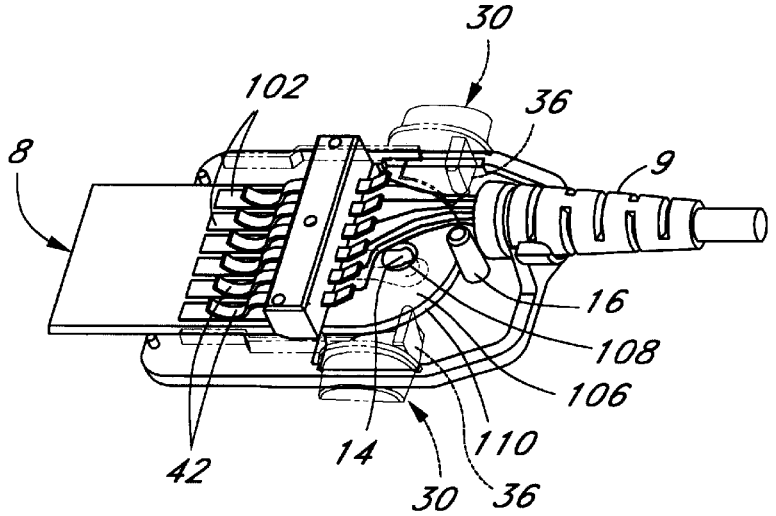
FIG. 4 is a perspective view of one presently preferred embodiment of the connector of the present invention with the male portion connected and the upper portion of the connector removed.

Insertion and release of the male portion 8 is exemplified in FIGS. 3, 4 and 5. FIGS. 3 and 4 depict the bottom case 10 and the contact block 40, but do not depict the top case 50. This is to allow illustration of insertion of the male portion 8. FIG. 3 also illustrates the release mechanisms 30 in phantom to assist in illustrating the release of the male insertion portion 8.

In FIG. 3 the male insertion portion 8 is shown detached. The male insertion portion 8 has electrical contacts 102, a plug portion 106, and a locking hole 108. A leading edge 110 of the male portion 106 is inserted into the sensor slot 56 of the connector 5. When fully inserted, the electrical contacts 102 of the male insertion portion connect with the contacts 42 of the contact block 40. This allows the signals being detected by the sensor (which connects to the electrical contacts 102 of the male insertion portion) to be transmitted via the contacts 42 to the cable 9 and to the monitor (not shown) via the cable 9. As illustrated in FIGS. 3 and 4, the contact between the electrical contacts 102 and the contacts 42 is a friction contact.

The male insertion portion 8 is advantageously made from a two-piece assembly such as a molded plastic tab and etched flex circuit. The contacts 102 are made through etching of a copper coating or other metallic coating on one side of the polymer. As the male portion 8 is inserted, the leading edge 110 of the male portion 8 contacts the stop bar 16, and the sensor lock 14 protrudes through the locking hole 108 as depicted in FIG. 4. The sensor lock 14 prevents the male portion 8 from being removed from the connector 5 unless released. If force is applied to pull the male portion 8 from the connector 5, the sensor lock 14 prevents the movement through the locking hole 108. The sensor lock 14 and the stop bar 16 act to fix the male insertion portion firmly in place. This reduces noise which may be generated from sliding of the male insertion portion with respect to the contacts 42 on the contact block 40.

In an embodiment with the retaining spring 14, the retaining spring further acts to hold the male insertion portion 8 from being removed by bearing down on the male insertion portion in the are of the sensor lock 14.

FIG. 4 shows the male portion 8 fully inserted into the female portion 7. To release the male portion 8 from the female portion 7, the user pushes both release buttons 32 into the female shroud portion 7. When the release buttons 32 are pushed into the connector 5, the lift tabs 34 raise the sensor plug portion 106 off of the sensor lock 14. The lift tabs 34 are wedge shaped to raise the sensor plug portion 106. The thickness of the lift tabs 34 is smallest on the inside edge and gradually increases as the lift tab 34 approaches the release buttons 32. When the release buttons are pressed, it forces the thicker portions of the lift tabs 34 to wedge between the inner face 22 of the bottom case 10 and exert pressure on the sensor plug portion 106 to lift the sensor plug portion 106 off the sensor lock 14. This allows the sensor or plug portion 106 to be removed from the connector 5 with a pulling motion.

At the same time the sensor plug portion 106 is raised off of the sensor lock 14, the push tabs 36 press the sensor 100 out of the female shroud portion 7. As the release buttons 32 are depressed, the leading edge of each push tab 36 comes in contact with the sensor plug portion 106 leading edge 110. As further depression of the release buttons 32 occurs, the push tabs 36 move together. Due to the U-shape of the leading edge 110 of the sensor plug portion 106, the action of the push tabs 36 coming together pushes the male insertion portion away from the stop bar 16. This pushing motion moves the locking hole 108 away from the sensor lock 14, thereby preventing the sensor lock 14 from re-engaging when the release buttons 32 are released. This allows a user to merely pull the male portion 100 from the connector 5 after the release buttons 32 have been depressed.

FIG. 4 shows the male insertion portion 8 completely locked in place in the connector 5. The locking hole 108 of the male insertion portion 8 is engaged on the sensor lock 14 of the connector 5. Also, the leading edge 110 of the sensor plug 106 is in contact with the stop bar 16 on the connector 5. In this arrangement the electrical contacts 102 couple with the contacts 42 of the contact block 40. FIGS. 3 and 4 also depict the cable 9 positioned with wires coupled to the connector tabs 44 of the contact block. Connection is advantageously through soldering.

FIG. 5 shows the complete connector 5 with the male insertion portion 8 inserted. The electrical connections within the female shroud portion 7 are substantially shielded from outside influence by the bottom case 10 and the top case 50. The electrical connections are also substantially shielded from liquid in the environment. The entire assembly 120 shown in FIG. 5 presents a low-profile connector 5 that is easily grasped by the user.

Numerous variations and modifications of the invention fall within the scope of the present invention. The preferred embodiment described above is, in all respects, illustrative, and not restrictive. Therefore, the scope of the invention is indicated by the appended claims, rather than by the foregoing description. All changes that come within the meaning and range of equivalency of the claims are to be embraced within their scope.

What is claimed is:

1. A connector for use with a sensor plug, said sensor plug having a plurality of signal contacts, said connector comprising:

a housing configured to accept at least an insertion end of the sensor plug;

a lock located within said housing, said lock configured to cooperate with said sensor plug to inhibit unintentional retraction of said insertion end with said sensor plug inserted in said housing;

at least one release mechanism movable from a normal position to a release position, said release mechanism extending into said housing in at least said release position, and said release mechanism configured such that when said release mechanism is moved to said release position, said release mechanism engages said insertion end when said insertion end is inserted into said housing and displaces said insertion end within said housing so as to disengage and move said sensor plug from said lock, said release mechanism configured to automatically return said release mechanism to said normal position; and an electrical connector secured within the housing, said electrical connector having contacts positioned within the housing at a position to cooperate with said signal contacts of said sensor plug with at least a portion of said sensor plug positioned within said housing.

2. The connector of claim 1, further comprising metallic shielding for said housing.

3. The connector of claim 2, further comprising metallic shielding for said release mechanism.

4. The connector of claim 1, further comprising a retaining spring which holds the sensor plug in place.

5. The connector of claim 2, further comprising a retaining spring which holds the sensor plug in place.

6. The connector of claim 2, said release mechanism having a lift tab portion to disengage said sensor plug from said lock when said release mechanism is moved to said release position.

7. The connector of claim 6, said release mechanism further having a push tab to displace said sensor plug from said lock when said release mechanism is moved to said release position.

8. An electrical connector comprising:

a case defining a shroud, said case having a passageway having a locking member and configured to accept a sensor plug;

at least one release mechanism movable from a normal position to a release position, said release mechanism configured such that when said release mechanism is depressed to said release position, the release mechanism releases the sensor plug from the locking member, unlocking the sensor plug from said case, said release mechanism having spring members to automatically return said release mechanism to said normal position; and an electrical block secured within the case, said electrical block having contacts positioned such that signal contacts of said sensor plug, when inserted into the case, engage the contacts of the electrical block.

9. The electrical connector of claim 8, wherein the locking member comprises a sensor plug lock.

10. The electrical connector of claim 8, wherein the case further comprises a stop bar positioned to prevent insertion of the sensor plug beyond a predetermined limit.

11. The electrical connector of claim 9, said release mechanism comprising a lift tab having at least one wedge portion.

12. The electrical connector of claim 11, wherein the release mechanism has at least one push tab, said push tab designed to move the sensor plug in a direction out of said case when said push tab is engaged.

13. The electrical connector of claim 8, wherein the electrical connector is attached to a cable.

14. The electrical connector of claim 13, wherein the cable has signal transmitters.

* * * * *